US007942458B2

(12) United States Patent
Patterson

(10) Patent No.: US 7,942,458 B2
(45) Date of Patent: May 17, 2011

(54) MAGNETIC GATE LATCH

(76) Inventor: Wayne Albert Patterson, Casselberry, FL (US)

( * ) Notice: Subject to any disclaimer, the term of this patent is extended or adjusted under 35 U.S.C. 154(b) by 0 days.

(21) Appl. No.: 12/381,780

(22) Filed: Mar. 17, 2009

(65) Prior Publication Data

US 2009/0273194 A1 Nov. 5, 2009

Related U.S. Application Data

(60) Provisional application No. 61/069,991, filed on Mar. 19, 2008.

(51) Int. Cl.
*E05C 5/04* (2006.01)

(52) U.S. Cl. ..... 292/251.5

(58) Field of Classification Search ..... 292/251.5; 70/276

See application file for complete search history.

(56) References Cited

U.S. PATENT DOCUMENTS 2,104,472 A * 1/1938 St Clair et al. ..... 335/286
3,288,511 A * 11/1966 Tavano ..... 292/251.5
4,099,755 A * 7/1978 Anderson ..... 292/251.5

* cited by examiner

*Primary Examiner* — Carlos Lugo
*Assistant Examiner* — Mark Williams

(57) ABSTRACT

A magnetic gate latch has a multiplicity of permanent magnets arranged on a pair of disks with half of the magnets in mutual attraction and half of the magnets in mutual repulsion. These magnetic forces are used to brake and close a gate or door. One of the disks is made axially movable with respect to the other so as to assume mutual repulsion in one position and mutual attraction in a second position. The movable disk is attached to a gate or door closing member and the other disk is attached to the closing structure post or jamb. Magnetic forces in the repulsion position are used in the invention to reverse the movable disk from a mutual repulsion position to a mutual attraction position.

1 Claim, 4 Drawing Sheets

REPULSION MODE

ATTRACTION MODE

MAGNETIC GATE LATCH

TECHNICAL FIELD OF THE INVENTION

The present invention relates to latches and closing mechanisms, and more particularly to an automatic magnetic repulsion and attraction device that prevents slamming of a gate or door against a closing structure and holding the gate or door in a closed position. A means of releasing the magnetic attraction is provided so that the gate or door can be opened. (Current U.S. Class: 292/251.5

The present invention in various embodiments offers new improvements to previously available latching devices and is particularly useful in automatic closing gates or doors. The invention described herein absorbs the closing momentum of a gate or door by means of a confrontation of magnetic repulsion forces of like magnetic poles in close proximity. The invention also provides a means of automatically closing a gate or door following such magnetic confrontation by switching from magnetic repulsion to magnetic attraction.

Physical principles of magnetism related to the invention are:

1. Opposing magnets will seek attraction of opposite magnetic poles when freely suspended.
2. The force of attraction or repulsion between two magnets varies directly as the product of the strength of the poles, and inversely with the square of the distance between them.

BACKGROUND OF THE INVENTION

Prior art has provided magnetic latching devices suitable for use on gates or doors where automatic latching is required. A major disadvantage of such prior art is the lack of protection from the impact of closing momentum (slamming) of a gate or door against a closing structure caused by spring-actuated hinges or other external forces such as air movement. Such slamming is noisy and often causes damage to both the latching device and/or the closing structure. The current invention provides a quiet, soft close.

While prior art has provided a manual selection type of reversible magnetic door stop, the current invention offers a significant improvement by automatically reversing from stop to close.

BRIEF SUMMARY OF THE INVENTION

The present invention is embodied in a device composed of permanent magnets attached to two disks. The magnets are arranged on the perimeters of said disks so that one half of each disk contains north pole oriented magnets and the other half contains south pole oriented magnets. The magnetic poles face outward toward an air gap between the two disks. When opposed to each other, the two disks can assume mutual repulsion or mutual attraction positions.

The first disk is made movable by means of an axially mounted shaft supported within a housing which enables the first disk to rotate with respect to the second disk. The first disk and housing is attached to a closing member of a gate or door and the second disk is mounted on the closing post or jamb of the closing structure of the gate or door.

When in the gate or door is in the open position, the first disk is maintained in magnetic repulsion mode relative to the second disk by means of a constant force spring with like poles facing each other. When the gate or door is brought to a close, the opposing magnetic forces briefly stop the closing motion until the attraction of opposite magnetic poles is sufficient to cause the first disk to rotate into a mutual attraction position relative to the second disk. The attraction forces of the magnets then bring the gate or door to a close and hold it in place.

A manually operated handle attached to a ratchet mechanism rotates the first disk so that like magnetic poles are brought together to allow the gate or door to be opened. A keyed cam type lock is provided to lock the ratchet mechanism in the closed position with a quarter turn of the key. In this position, the magnets of the first and second disks remain in attraction mode so that the gate or door remains magnetically latched with a force field of 118 Lbs. Various embodiments can provide greater or lesser magnetic strengths, depending on the size and weight of the gate or door.

DETAILED DESCRIPTION OF THE INVENTION

Referring to FIGS. 1 through 6, wherein like reference numbers refer to like components and numerals with free standing arrows represent assemblies in the various views, there is illustrated a new and improved magnetic latching device. The best contemplated mode of operation is shown in fully assembled and exploded forms.

The invention described herein has its widest application as a means of eliminating slamming and quiet closing of automatic closing gates or doors. However, the unique features of the invention have possibilities for other applications where it is desirable to transmit motion from one part to another without physical connection.

Figure 1:
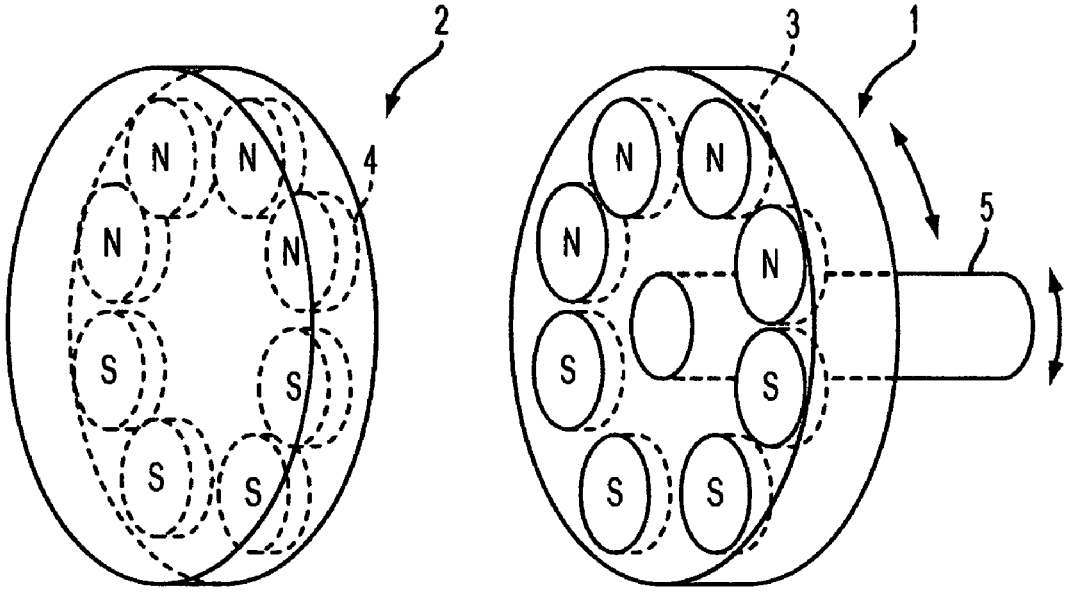
FIG. 1 of the drawings shows a movable disk assembly 1 and a fixed disk assembly 2 illustrating the arrangement of eight permanent magnets 3 and 4 on each disk. The magnets are in repulsion position with like poles facing each other through an air gap.

Referring to FIG. 1, the two basic elements of the invention are illustrated. A movable first disk assembly 1 and a fixed second disk assembly 2 have multiple permanent magnets 3 and 4 arranged around the disks' perimeters, so one half of each disk contains north pole orientation and one half contains south pole orientation. The magnets are press-fitted into blind holes in disks of non-magnetic material and coated with a suitable resin. These assemblies will be referred to hereinafter as first disk and second disk respectively. The first disk is made axially moveable in the directions indicated by a shaft 5. In their relative positions as shown, the first and second disks will repel each other. The magnets are axially magnetized neodymium grade N50 with a pull or repulsion force of 19.2 Lbs. each. The mutual repulsion force of one of these magnets is the product of each opposing magnet (19.2×19.2=368 Lbs.) This force is reduced inversely by the square of the distance between them in centimeters, which force increases exponentially as they come closer together, checking the close of a gate or door.

Figure 2:
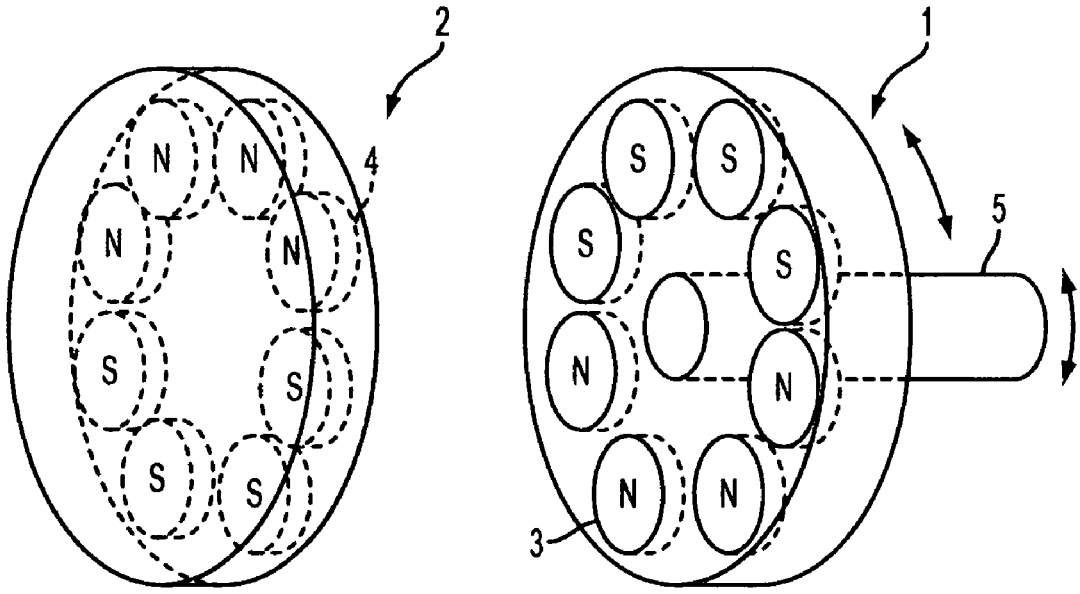
FIG. 2 of the drawings shows the disk assemblies 1 and 2 with their magnets in attraction position with opposite poles facing each other through an air gap.

Referring to FIG. 2, the first and second disks 1 and 2 are shown after the first disk 1 has rotated 180 degrees on shaft 5 into a position of attraction with respect to the magnetic poles on the second disk 2. Rotation of the first disk is the result of the unique polar configuration of the magnets 3 and 4. The basic concept of the current invention is based on that rotary action which automatically reverses the magnets from repulsion to attraction. In the attraction mode, the gate or door is held securely by a force equal to the mutual repulsion force described above.

Figure 3:
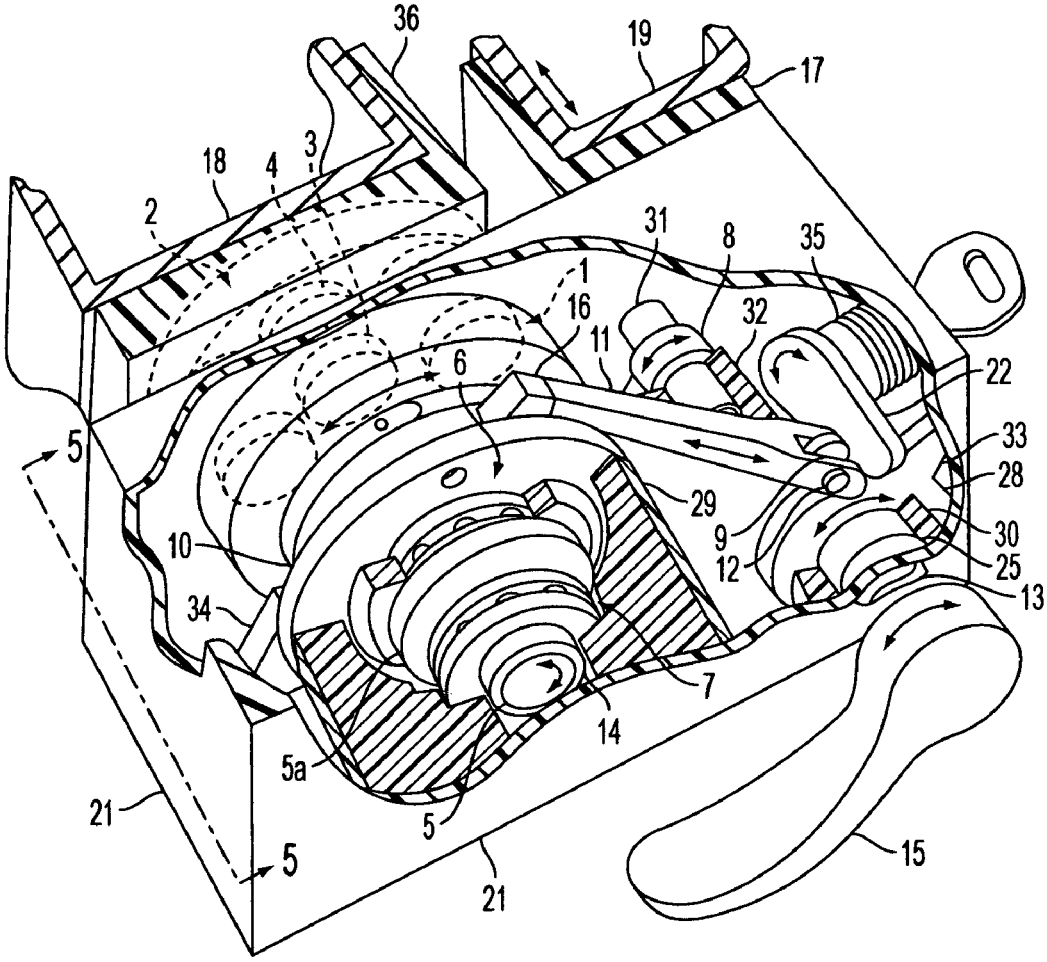
FIG. 3 of the drawings is the preferred view for the front page. It shows the preferred embodiment of the invention in perspective view through a cut-away of housing 21, and sections through support pillars 29, 30, 32 to show the various components comprising the device. The view also shows a gate closing post 18 and a gate closing member 19 in closed position. The direction of movement of moving parts is illustrated with free standing arrows.

The components are shown in more detail in FIG. 3. A mounting structure 29 is provided for the first disk 1 wherein shaft 5 turns in oil filled bronze bearing 14. Retainer plate 10 attaches to mounting structure 29 to retain a pair of thrust bearings 6 and 7. Shaft 5 has a machined spacer 5-a, which bears alternately on bearing 7 in repulsion mode and bearing 6 in attraction mode. A ratchet mechanism composed of a rotary arm 9, a pivot pin 12, a pawl 11, and the push pin 16 on first disk 1 actuated by handle 15 attached to shaft 13 rotates first disk 1 out of attraction mode enabling its separation from second disk 2. Shaft 13 is supported by an oil filled bronze bearing 25. Constant force spring 8, supported by mounting structure 32 spins on shaft 31, alternately contracting and extending around the perimeter of first disk 1, serving as a means of returning the disk to repulsion mode after the ratchet mechanism function has separated first and second discs 1 and 2. Spring 8 also functions to retard the rotation of first disk 1 during the closing sequence. Lock 35 has a cam arm 22 that rotates a quarter turn to retain locking arm 33 to block ratchet functions. Second disk 2 is shown attached to closing post 18. Housing 21 is shown attached to a gate closing structure 19 by means of a sliding interface with bracket 17.

Figure 4:
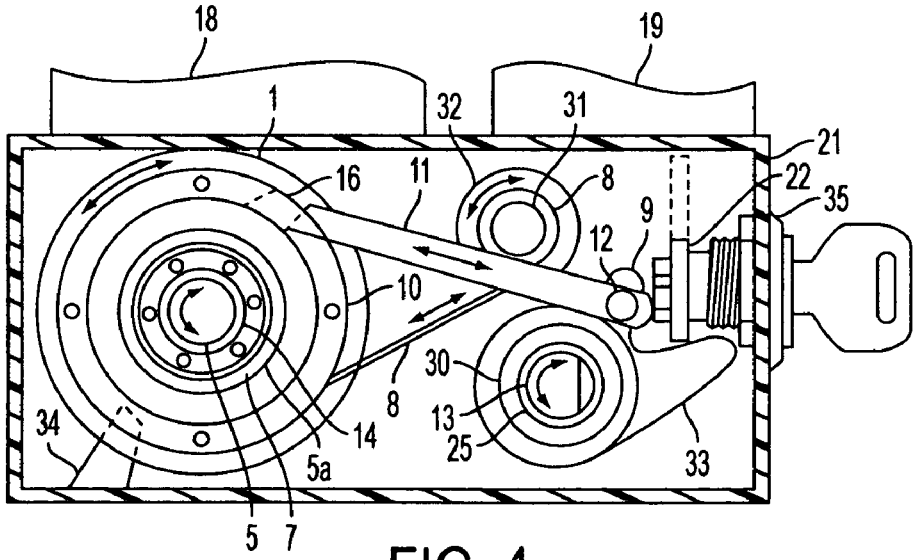
FIG. 4 of the drawings shows an elevation view of the device as seen through a cut away of the housing 21. Changed positions of components after actuating shaft 13 are shown with broken lines, and the direction of movement of moving parts is illustrated with free standing arrows.

Referring now to FIG. 4, the components are shown in elevation view. Rotation stop 34 which limits the travel of first disk 1 is shown in this view.

Figure 5:
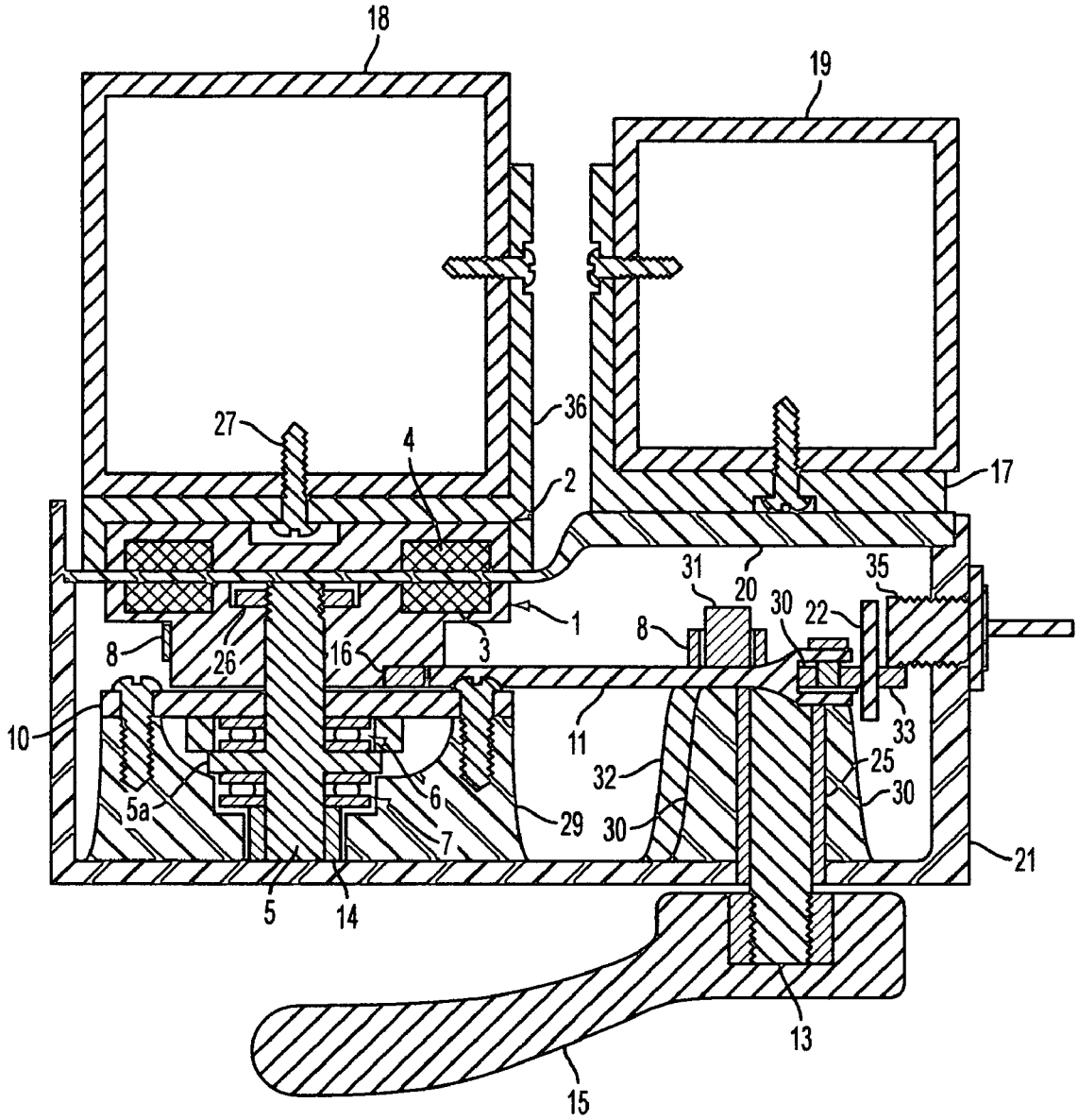
FIG. 5 of the drawings shows a top view of the preferred embodiment as a horizontal section through the housing 21.

FIG. 5 shows a sectional view of the components viewed from the top of the device. This view shows in more detail the proximity of disks 1 and 2 in the attraction position. Also shown are the fastener locations at mounting brackets 17 and second disk 2.

Figure 6:
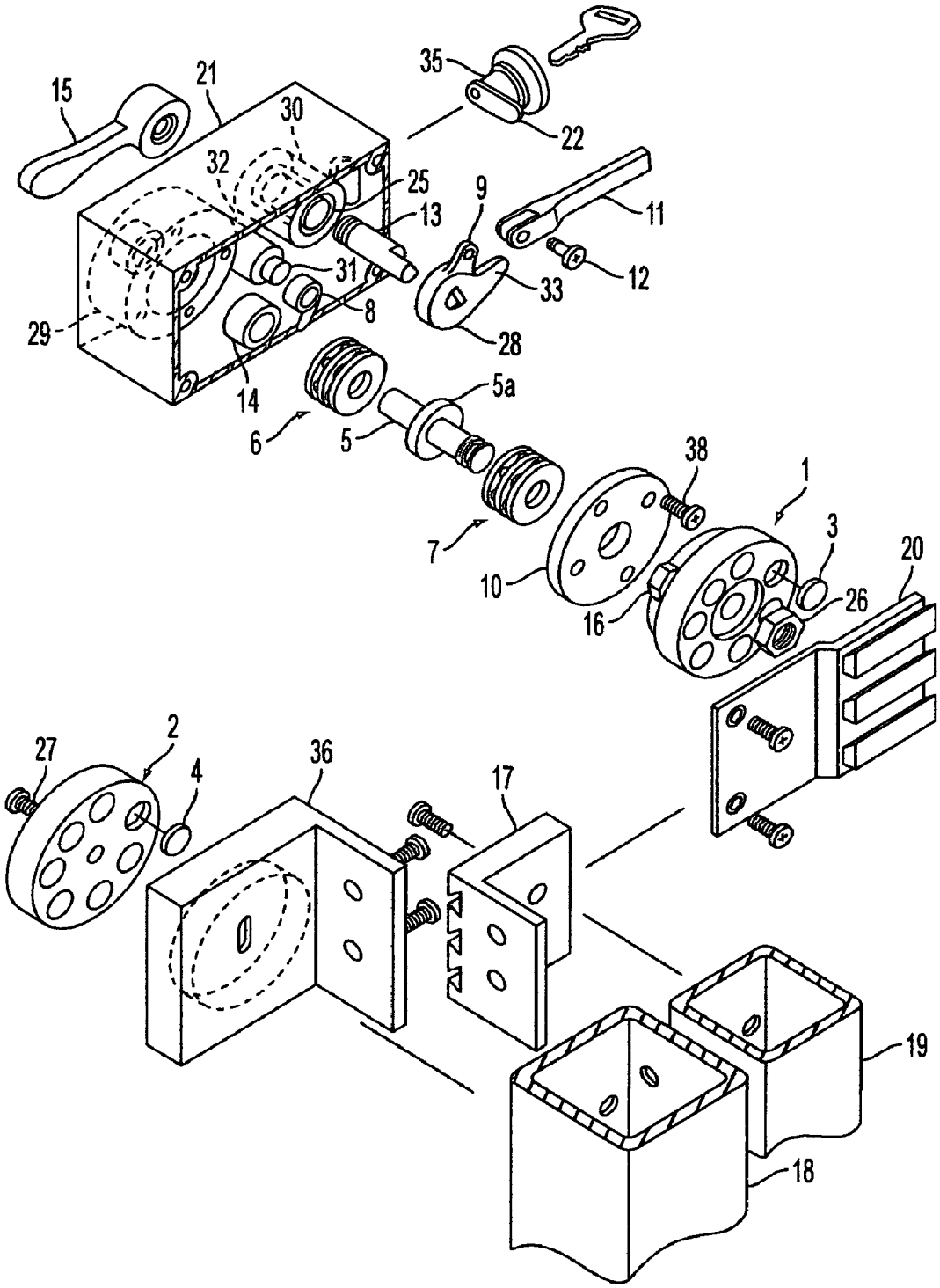
FIG. 6 of the drawings is an exploded isometric view of the preferred embodiment.

FIG. 6 shows the components in exploded view. It also details the housing cover 20 and its matching mounting bracket 17 as well as the various screw fasteners require for assembly and attachment to a gate closing structure 19.

All bushings, spring, bearings, lock, and magnets shown in the drawings are off the shelf items. All shafts are stainless steel stock machined to drawing specification. The housing assembly and disk blank assemblies are to be produced by injection molding of high strength plastic material.

What is claimed is:

1. A self-reversing device for checking and latching a gate or door, said device comprising a multiplicity of magnets on a pair of confronting disks, where the magnetic poles are uniquely arranged with all north poles adjacent on one half of each confronting disk and all south poles adjacent on the other half of each confronting disk; one of the pair of confronting disks is axially movable with an attached shaft and said disk is urged by a spring to rotate into repulsion mode with like poles of said pair of disks in opposition, and the other one of the pair of confronting disks is fixed; the fixed one of the pair of confronting disks is attached to a closing post and the other moveable one of the pair of confronting disks is attached to a gate or door structure;

a closing action of the said gate or door structure first brings the said movable disk toward the said fixed disk in repulsion mode with confronting like magnetic poles of the said pair of disks checking the closing, and;

a concurrent magnetic attraction of opposite poles on the said pair of confronting disks causes the moveable one of the pair of confronting disks to overcome said spring and rotate axially with the said attached shaft into attraction mode, bringing the pair of disks together, completing the closing action against said closing post with reduced impact and noise, and holding said gate or door structure against said closing post.

* * * * *